United States Patent [19]

Olah

[11] 4,394,247

[45] Jul. 19, 1983

[54] LIQUEFACTION OF COALS USING RECYCLABLE SUPERACID CATALYST

[76] Inventor: George A. Olah, 2252 Gloaming Way, Beverly Hills, Calif. 90210

[21] Appl. No.: 290,260

[22] Filed: Aug. 5, 1981

[51] Int. Cl.[3] ..... C10G 1/06

[52] U.S. Cl. ..... 208/10

[58] Field of Search ..... 208/10

[56] References Cited

U.S. PATENT DOCUMENTS

| | | | |
|---|---|---|---|
| 4,036,738 | 7/1977 | Wristers | 208/112 X |
| 4,089,772 | 5/1978 | Gorbaty et al. | 208/8 LE |
| 4,090,944 | 5/1978 | Moore | 208/10 |
| 4,092,235 | 5/1978 | Schlosberg | 208/10 |
| 4,202,757 | 5/1980 | Amendola | 208/10 |

*Primary Examiner*—Delbert E. Gantz
*Assistant Examiner*—William G. Wright
*Attorney, Agent, or Firm*—Pennie & Edmonds

[57] ABSTRACT

This invention discloses a process for the liquefaction of coals and other predominantly hydrocarbonaceous materials by treating the same with a superacidic catalyst system consisting of anhydrous hydrogen fluoride and boron trifluoride in the presence of super-atmospheric hydrogen.

5 Claims, 1 Drawing Figure

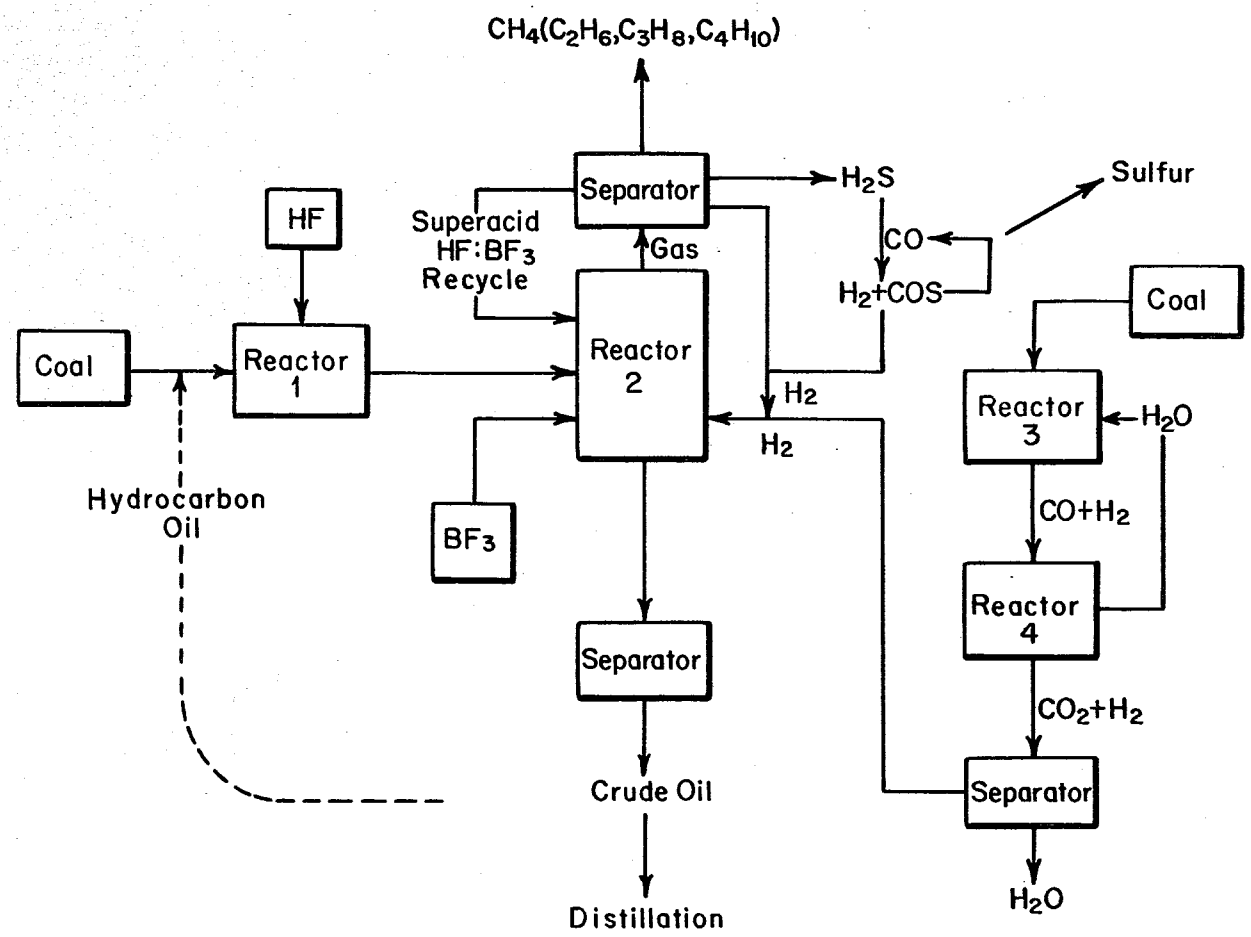
Coal
Reactor 1
HF
Hydrocarbon Oil
Superacid HF:BF3 Recycle
Reactor 2
BF3
Separator
Gas
CH4(C2H6,C3H8,C4H10)
H2S
CO
H2+COS
Sulfur
H2
H2
Separator
Crude Oil
Distillation
Coal
Reactor 3
H2O
CO+H2
Reactor 4
CO2+H2
Separator
H2O

LIQUEFACTION OF COALS USING RECYCLABLE SUPERACID CATALYST

TECHNICAL FIELD

This invention discloses a process for the liquefaction of coals and other predominantly hydrocarbonaceous materials by treating the same with a superacidic catalyst system consisting of anhydrous hydrogen fluoride and boron trifluoride in the presence of super-atmospheric hydrogen.

BACKGROUND ART

Coal liquefaction is of major significance as an alternative synthetic fuel source. The conversion of coal into liquid (as well as gaseous) hydrocarbons according to existing technology can be carried out either by direct hydrogenation or through prior conversion to synthesis gas followed by Fisher-Tropsch synthesis. The existing processes are based upon technology developed in Germany during the 1920's employing improved engineering techniques.

Hydrogenation of coals producing liquefied products generally follows two main courses: solvent assisted hydrogenation at 300° to 400° C. and at 1000–4000 psi or higher temperature flash pyrolysis (600° to 1000° C.), either at ambient hydrogen pressure or hydrogen pressure up to 1500 psi. The solvent assisted liquefaction has the virtue of being able to obtain a high yield coal conversion to liquid products of relatively low molecular weight.

The use of catalysts in coal liquefaction processes causes, in general, significant difficulties. Coal is a solid material with very limited solubility in most common solvents (organic or inorganic). Thus, a major difficulty or problem in transforming coal catalytically is finding a means to bring hydrogen gas in proper contact with the coal. This fact obviously causes significant and as yet unresolved problems, if a solid catalyst is used. Even when employing a very fine mesh coal (mesh size 100$\mu$), there is little surface contact. Also, the organic moiety of coals is a cross-linked polymeric material, which can only be partially dissolved or swelled by organic solvents. Thus, a homogeneous catalyst should also be preferentially soluble and compatible with solvents used or the reaction conditions should be such to allow the catalyst to make molecular contact with the large organic cross-linked molecules of coals. Further, the large polyaromatic polynuclear coal backbone must be depolymerized during the process to allow the formation of hydrogenated lower molecular weight hydrocarbons.

The phenol complex of boron trifluoride, a well defined acidic system (see G. A. Olah "Friedel-Crafts Chemistry", Wiley-Interscience New York, 1973, pp 247–248), was applied by Heredy in studies of depolymerization of coals and model compounds. (L. Heredy et al., Fuel, 41, 221 (1962), 42, 182 (1963), 43, 414 (1964), 44, 125 (1965)). This system is, however, a relatively weak acid system, which when heated slowly releases boron trifluoride starting at about 50° C. Practically no boron trifluoride remains at the boiling point of phenol. No liquefaction of coal was reported in the phenol-boron trifluoride system, nor is it expected to be achieved due to the low acidity of the system and its inability to promote ionic hydrogenation. This system is thus well-recognized to be entirely different from the hydrogen fluoride-boron trifluoride superacid system of this invention (see Olah "Friedel-Crafts Chemistry" p. 244), a system previously used in the petrochemical industry, for example, for the isomerization of xylenes, but not applied previously in coal chemistry.

Friedel-Crafts type systems, such as zinc chloride or aluminum chloride-hydrochloric acid with hydrogen, were utilized previously in coal liquefaction, their use is of limited value because these acid catalyst systems cannot be readily regenerated, and in the latter case, results primarily in the formation of gaseous products, such as methane and ethane. Further, elevated reaction temperatures are needed in these energy consuming processes.

The application of Lewis acid catalyzed coal conversion has gained interest in recent years for producing liquid and gaseous products at temperatures between 200° and 500° C., generally 350° to 450° C. Zinc chloride in particular is utilized in the CONOCO process. Further it is known that active Lewis acid catalysts can be effective gasification catalysts under hydrocracking conditions by themselves (such as discussed by W. Kawa, S. Friedman, L. V. Frank and R. W. Hiteshue, *Amer. Chem. Soc. Division of Fuel Chemistry,* Vol. 12, No. 3, 43 (1963)) or with Lewis acid protic acid conjugated superacid systems, such as aluminium chloride and hydrochloric acid (J. Y. Low and D. S. Ross, ibid, 22, No. 7, 118 (1977).

U.S. Pat. No. 4,202,757, to Amendola issued May 13, 1980, describes the rapid conversion of coal to a high percentage of liquid hydrocarbons by first reacting it with an acid to form carbon addition products, which are then reacted with a Group V halide ion acceptor system (i.e., superacid system), such as antimony pentahalides, and thereafter with a hydrogen donor source. All phases are claimed to be carried out at atmospheric pressure and relatively low temperatures (150° to 500° C.).

Zinc chloride and aluminum chloride as well as the related Lewis acid halides of high redox potentials, are described as applicable in these processes, but are extremely difficult to recover due to their limited volatility and strong complexing with the basic sites abundant in coal. The Group V halides claimed by U.S. Pat. No. 4,202,757 are generally unsuitable and impractical catalysts for coal conversion because their hydrolytic ability and generally high chemical reactivity result in irreversible reactions with coals. Also, their redox potential is low, and they are thus easily reduced under the reaction conditions. Antimony pentahalides, for example, generally are not compatible, as is well known to those familiar with superacid chemistry, with hydrogen or hydrogen donors. Further, antimony pentahalides are extremely reactive with water and any other nucleophiles abundant in coals or other carbonaceous materials. As known to those familiar with their chemistry, when reacted with coals, antimony pentafluoride or its conjugate superacids give insoluble, rock-like materials, which are neither converted to hydrocarbon oils or gases and do not allow recovery of the halide. Due to these difficulties and despite appreciable effort, none of the catalytic processes described in U.S. Pat. No. 4,202,757 has so far resulted in any practical process of improved nature.

SUMMARY OF THE INVENTION

The present invention describes an effective, new economical process to liquefy coal or other predominantly hydrocarbonaceous materials to hydrocarbons utilizing superacid catalyzed depolymerization/hydrogenation. A specific superacid system composed of hydrogen fluoride and boron trifluoride, in the presence of hydrogen gas under moderate to high pressures and moderate temperatures overcomes many of the aforementioned difficulties. Recyclable anhydrous hydrogen fluoride and boron trifluoride provide both a suitable reaction medium, as well as a very effective catalytic system to allow the depolymerization-hydrogenation of coals under mild conditions, to form liquid hydrocarbons with the co-formation of smaller amounts of gaseous hydrocarbons. The process is efficient and can be carried out under surprisingly mild conditions.

DETAILED DESCRIPTION OF THE INVENTION

It is a significant aspect of my invention that the hydrogen fluoride-boron trifluoride superacid medium is completely recoverable and recyclable. This is partly due to the high volatility of the system. Hydrogen fluoride has an atmospheric boiling point 20° C. and boron trifluoride has an atmospheric boiling point −101° C. Further, complexes of boron trifluoride with water, hydrogen sulfide or various other nucleophilic donors present in coal can be readily decomposed, allowing the regeneration of boron trifluoride by thermal or acid treatment. Due to the extremely high redox potential of hydrogen fluoride and boron trifluoride, there are no oxidation-reduction processes taking place. Thus, there is no loss of the superacidic reaction medium, allowing economical conversion of coal under the exceedingly mild conditions.

Residual moisture in the coals may be removed by dehydration by boron trifluoride in the form of stable hydrate. The hydrate can be readily regenerated by heat treatment or with oleum or sulfur trioxide, liberating boron trifluoride gas. There is thus no significant loss of the acid system in the process. The acid system also acts as an advantageous reaction medium in conjunction with hydrocarbon oil for the process, allowing good contact and providing suitable continuously renewed active cationic sites on the coal surface to maintain the hydrogenation reaction.

The conversion reaction can be carried out at temperatures between 50° and 250° C., preferentially between 100° and 175° C., at pressures ranging from 25 to 150 atmospheres, preferably between 35 to 75 atmospheres.

Coal, after suitable drying and pulverization, is fed by slurrying with a hydrocarbon oil, particularly partial recycling of the products obtained, into a reactor containing hydrogen fluoride, which is then subsequently pressurized with the boron trifluoride and hydrogen, and heated to the required reaction temperature for suitable periods of time ranging from 1 to 24 hours, preferably from 2 to 6 hours, to achieve hydroliquefaction. The actual ratio of hydrogen fluoride to boron trifluoride for 200 ml of hydrogen fluoride and 960 psi of boron trifluoride is approximately 1:1.3. In general, the hydrogen fluoride-boron trifluoride mole ratio should be from about 0.5 to 2 to 1. The reaction can be carried out batchwise; in a continuous process, the components are fed as is known in the art of coal treatment.

It is part of the invention that the superacid catalyzed mild depolymerization can be utilized as a first step followed by conventional coal hydrogenation, or, alternatively, the invention can also utilize ionic hydrogenation promoted by the acidic catalyst itself.

After completed conversion, the acid system is removed by depressurization, separated into its components and, after separation from any gaseous hydrocarbons (particularly methane and ethane), is recycled. The converted coal is treated in a conventional way, distilling any coal oils formed, with subsequent refining.

The significant advantages of the present invention are the ability of the superacids to depolymerize coals under mild conditions via protolytic cleavage of bridging linkages (such as methylene, ethylidene, ether, sulfide, etc.), as well as to effect ring cleavage processes. The lowered molecular weight and ring opened carbon structures, thus, can undergo either conventional hydrogenation reactions, or hydrogenation promoted by the acid system itself, which is considered to be primarily of an ionic hydrogenation nature, i.e., the reaction of hydrogen with carbocationic centers and related hydrogen transfer reactions.

A further significant aspect of the present invention is the insensitivity of the superacidic system to high levels of sulfur and other impurities, allowing the utilization of a wide variety of coals, even of low grades with high levels of these impurities, which are detrimental in other catalytic hydrogenation processes.

The ratio of gaseous to liquid hydrocarbons can be varied by raising the reaction temperatures, indicating the superacids ability to further protolytically cleave side chains or already-formed hydrocarbon products to lower molecular weight hydrocarbons, primarily of the $C_1$ to $C_4$ range. Thus, the ratio is adjustable to increase lower molecular weight gaseous hydrocarbons with more forcing and prolonged reaction conditions, or alternatively to limit their formation and maximize liquid products by carrying out the coal hydrogenation under the milder conditions described in the invention. When the process of my invention is operated at higher temperatures (200° to 500° C.), increasingly lower molecular weight gaseous hydrocarbons, particularly methane and ethane, are formed; thus under these conditions, the process operates primarily for the gasification of coals.

The hydrogen gas needed to carry out the liquefaction process can be obtained by usual manners, including preferentially the water gas shift reaction of coal or methane or its modifications. Further methane and lower hydrocarbons can themselves act as internal sources for hydrogenation and/or alkylation, contributing to coal liquefaction.

Sulfur containing coals provide hydrogen sulfide as the by-product of the conversion process. Hydrogen sulfide is also frequently obtained from other carbonaceous materials. It is part of my invention, that a practical, simple way was found to utilize hydrogen sulfide in the liquefaction process as an internal source of hydrogen. When hydrogen sulfide is treated with carbon monoxide under conditions of the well known shift reaction, preferably with a transition metal sulfide catalyst, hydrogen is formed with carbonyl sulfide as by-product. Carbonyl sulfide can be subsequently cleaved to carbon monoxide and sulfur, thus allowing ready recycling of carbon monoxide and removal of sulfur, providing a clean additional source of hydrogen gas for the liquefaction process.

In one embodiment of the invention, coal, after drying and pulverization to suitable size, is contacted with hydrogen gas in the presence of the hydrogen fluoride-boron trifluoride system, to achieve liquefaction. The superacidic system is insensitive to sulfur and nitrogen compounds, and other impurities predominant in coals, which adversely affect most other catalytic (homogeneous or heterogeneous) catalyst systems. The hydrogen fluoride-boron trifluoride system is further nonreducible, and thus, its activity is not diminished by hydrogen. In addition, the hydrogenation step can be carried out in the presence of various solvents, such as isoalkanes. If needed, the depolymerization treatment can be operated separately, followed by conventional hydrogenation of the pre-treated coal. In all of its embodiments, the present invention is considered to represent an improved, economical coal liquefaction system applicable to large scale production of hydrocarbons of relatively modest molecular weight, which subsequently can be refined to produce both gasoline range hydrocarbons and other hydrocarbon products usually obtainable from petroleum.

The process of my invention is also applicable to other carbonaceous materials, such as tar sands, oil shales, heavy bitumenous oils or asphalts or like fossil fuel sources.

EXAMPLES

The following examples are illustrative of the invention, are set forth for the purpose of illustration only and are not to be construed as limiting the scope of the invention in any manner. The schematic process of Example 4 presents a practical embodiment of the process.

Example 1: Laboratory liquefaction of coal with hydrogen fluoride-boron trifluoride Lump coal, generally Illinois No. 6, was first dried in vacuo at 105° C. and then pulverized into a particle size of 50 microns and dried again at 105° C. Into a stirred 21 Monel 400 High Pressure Reactor equipped with a Teflon liner, 20 grams of dried coal was charged. The autoclave was then closed, transferred to an ice bath, and cooled to 0° C. The reactor was charged with 200 ml of liquid hydrogen fluoride sealed, and warmed to 25° C. After charging the autoclave with 980 psig of boron trifluoride and 600 psig hydrogen, respectively, the autoclave was placed in a heating mantle equipped with automatic temperature control and heated to 150° C. After four hours the autoclave was cooled, depressurized and the acid (hydrogen fluoride and boron trifluoride) distilled for recycling.

The gaseous hydrocarbons collected upon depressurization of the reactor amounted to approximately 14% of the coal feed. The hydrocarbon-gas mixture consisted mainly of $C_3$, $C_4$ and higher hydrocarbons, with small amounts of methane and ethane. A typical composition of the hydrocarbon gas mixture obtained is as follows:

Methane—9%
Ethane—4%
Propane—30%
$C_4$—57%

The treated coal was subsequently vacuum distilled at a pressure $10^{-3}$ to $10^{-2}$ torr, and a temperature of 350°-400° C. The distillation yielded an oil that consisted of polynuclear aromatics with an average aromatic structure consisting of two fused rings and a molecular weight in the range of 150-600. The hydrocarbon distillate oil was completely soluble in chloroform, and amounted to 35% of the coal feed.

Example 2: Laboratory liquifaction of coal with hydrogen fluoride-boron trifluorides in the presence of isopentane The reaction was carried out as in example 1, except that after charging the pressure vessel with 20 grams of dried coal and cooling it in an ice bath, 100 ml. of isopentane was added to it followed by 200 ml. of hydrogen fluoride. After sealing the vessel, it was warmed up to 25° C. and boron trifluoride (980 psig) and hydrogen (600 psig) were introduced. The autoclave was then heated to approximately 150° C. for four hours after which it was depressurized. A 15% loss in the amount of coal was observed representing hydrocarbon gases of similar composition as in example 1. The treated coal was subsequently distilled at 350°-400° C. and $10^{-3}$ to $10^{-2}$ torr. The hydrocarbon distillate oil amounted to 37% of the coal feed.

Example 3: Laboratory depolymerization of coal with hydrogen fluoride-boron trifluoride for subsequent hydrogenation The treatment of coal was carried out with hydrogen fluoride and boron trifluoride as in example 1, but no hydrogen gas was added. After the depolymerization, hydrogen fluoride and boron trifluoride were distilled off from the treatment vessel for recycling. The treated coal can then be utilized under conventional conditions of metal catalyzed hydrogenation conditions for liquifaction.

Example 4: Practical Embodiment of Hydrogen fluoride-boron trifluoride coal liquefaction process Pulverized coal, after drying, is fed into reactor 1 as depicted in the attached Figure by slurring with hydrocarbon oil (hydrogenated anthracene, naphthalene or the like) or, during continued operation, by recycling part of the hydrocarbon products. The coal is then contacted in the reactor with anhydrous hydrogen fluoride, and the combined slurry pumped into reactor 2 where it is pressurized with boron trifluoride (recycled with hydrogen fluoride from the hydrogenation reactor) and hydrogen gas (from the water gas shift reactor operating on excess coal). The depolymerization/hydrogenation reactor is preferentially operated at temperatures between 150° and 200° C. and pressures of 50 to 150 atm. Gaseous products (lower alkanes) are separated, as is the superacid (hydrogen fluoride-boron trifluoride), for recycling.

The liquefied hydrocarbons together with unreacted solids and other products produced in reactor 2 are transferred after separation for distillation and processing.

The hydrogen needed for the process is produced in reactors 3 and 4 according to the known water gas shift reaction. Hydrogen sulfide produced from sulfur containing coals is treated after separation with carbon monoxide to produce hydrogen; any carbonyl sulfide by-product is catalytically decomposed to regenerate carbon monoxide.

I claim:

1. A process for the liquefaction of coals or other predominantly hydrocarbonaceous materials by treatment thereof with hydrogen gas under superatmospheric pressure of 25-150 atmospheres at temperatures of 50°-250° C. in the presence of a superacidic system comprising anhydrous hydrogen fluoride and boron trifluoride, present in a mole ratio of about 0.5 to 2 to 1.

2. The process of claim 1 in which the temperatures used are between about 100° and 250° C. and the pressures used are between about 35 to 75 atmospheres.

3. The process of claim 1 further including the step of recovering and recycling the superacidic system.

4. The process of claim 1 further including the step of using the hydrogen sulfide produced as a by-product of the process to form hydrogen gas to be utilized in the process.

5. A process for the liquefaction of coals or other predominantly hydrocarbonaceous materials comprising the steps of (i) treatment thereof with a superacidic system comprising hydrogen fluoride and boron trifluroide, present in a mole ratio of about 0.5 to 2 to 1, to effect depolymerization followed by (ii) conventional catalytic hydrogenation of the depolymerized products prepared in step (i).

* * * * *